US010368627B2

(12) United States Patent
Johnsson et al.

(10) Patent No.: US 10,368,627 B2
(45) Date of Patent: Aug. 6, 2019

(54) HARNESS AND METHOD FOR MANUFACTURING THEREOF

(71) Applicant: INTERSPIRO AB, Lidingo (SE)

(72) Inventors: Anders Johnsson, Spanga (SE); Andreas Lindell, Vallingby (SE)

(73) Assignee: INTERSPIRO AB, Lidingo (SE)

( * ) Notice: Subject to any disclaimer, the term of this patent is extended or adjusted under 35 U.S.C. 154(b) by 95 days.

(21) Appl. No.: 15/545,941

(22) PCT Filed: Jan. 26, 2016

(86) PCT No.: PCT/EP2016/051558

§ 371 (c)(1),
(2) Date: Jul. 24, 2017

(87) PCT Pub. No.: WO2016/120265

PCT Pub. Date: Aug. 4, 2016

(65) Prior Publication Data

US 2018/0008031 A1 Jan. 11, 2018

(30) Foreign Application Priority Data

Jan. 26, 2015 (SE) ..... 1550076

(51) Int. Cl.

| | |
|---|---|
| ***A45F 3/14*** | (2006.01) |
| ***A62B 25/00*** | (2006.01) |
| *A62B 35/00* | (2006.01) |

(52) U.S. Cl.

CPC ..... *A45F 3/14* (2013.01); *A62B 25/00* (2013.01); *A45F 2003/146* (2013.01); *A62B 35/0025* (2013.01)

(58) Field of Classification Search

CPC ..... A45F 3/14; A45F 2003/142; A45F 2003/144; A45F 2003/146;

(Continued)

(56) References Cited

U.S. PATENT DOCUMENTS 3,670,509 A * 6/1972 Walters ..... B63C 11/30 114/315
3,957,183 A * 5/1976 Gadberry ..... A45F 3/00 224/628

(Continued)

FOREIGN PATENT DOCUMENTS

| | | |
|---|---|---|
| EP | 2248439 A1 | 11/2010 |
| WO | WO-9628065 A1 | 9/1996 |
| WO | WO-2009022258 A2 | 2/2009 |

OTHER PUBLICATIONS

International Search Report and Written Opinion for International Application No. PCT/EP2016/051558, dated Apr. 21, 2016.

(Continued)

*Primary Examiner* — Corey N Skurdal
(74) *Attorney, Agent, or Firm* — Marshall, Gerstein & Borun LLP

(57) ABSTRACT

A harness for a breathing apparatus includes an interface member (6) having an elongated shape and being configured for receiving a container of breathable gas of the breathing apparatus. A hip belt (2) is connected to the interface member at a first region (50) of the interface member. A first shoulder belt (16) and a second shoulder belt (18) are connected to the interface member at the first region and at a second region (52) of the interface member. The hip belt and/or the first and second shoulder belts comprise at least one first molded heat resistant plastic material.

26 Claims, 4 Drawing Sheets

(58) Field of Classification Search
CPC ..... A45F 2003/148; A62B 25/00; A62B 35/0018; A62B 35/0025
USPC ..... 224/633, 628, 637, 642, 645
See application file for complete search history.

(56) References Cited

U.S. PATENT DOCUMENTS

| | | | | |
|---|---|---|---|---|
| 5,363,790 | A * | 11/1994 | Matsuoka | B63C 11/08 114/315 |
| 5,695,102 | A | 12/1997 | Jackson | |
| 5,902,073 | A * | 5/1999 | Eungard | B63C 11/02 2/2.15 |
| 6,755,594 | B1 * | 6/2004 | Jacoway | B63C 11/30 405/186 |
| 8,844,116 | B2 * | 9/2014 | Couzyn | B63C 11/02 156/91 |
| 2004/0065272 | A1 | 4/2004 | Reynolds et al. | |
| 2005/0098597 | A1 * | 5/2005 | Cottrell | A45F 3/10 224/620 |
| 2011/0048421 | A1 | 3/2011 | Carr et al. | |

OTHER PUBLICATIONS

Office Action for Application EP 16 701 753.2, dated Jan. 28, 2019.

* cited by examiner

HARNESS AND METHOD FOR MANUFACTURING THEREOF

CROSS-REFERENCE TO RELATED APPLICATIONS

This is the United States national phase of International Patent Application No. PCT/EP2016/051558, filed Jan. 26, 2016, and claims the benefit of priority to SE 1550076-2, filed Jan. 26, 2015, the entire contents of both of which are hereby incorporated herein by reference.

TECHNICAL FIELD

The invention relates to a new type of harness for rescue and emergency applications in particular to a harness comprising a container with breathable gas for fire fighters.

BACKGROUND

Harnesses for rescue and emergency applications, for example firefighting, are subject to tough conditions and temperatures. The harnesses not only have to carry comparably heavy containers comprising breathable gas of a breathing apparatus they also need to withstand heat, dirt, smoke and soot particles.

Conventional harnesses comprise two shoulder belts and a hip belt, each of the shoulder belts and hip belt attached to a structural support, which is configured to rest on a carrier's back when the harness is in use. The structural support is used to removably fix and hold a container of breathable gas. The structural support is typically made of a rigid heat resistant plastic. The harness is carried similar to a conventional backpack whereby shoulder belts and hips belts can be adjusted to the size of the carrier.

It is known to provide shoulder belts and hip belts made of a woven fabric for example Kevlar or Nomex. Such belts are at least more or less flame retardant. Such belts must be sealed at the end to prevent them from fraying. Since it is not possible to use heat to seal the ends, they are usually folded over several times and then stitched. When a harness has been in use and thus when it has been exposed to extinguishing water, heat, soot particles, smoke and other dirt, it needs to be thoroughly cleaned. However, the woven fabric of the belts makes it very difficult to get all particles, in particular smoke and soot particles out of the belts. When these particles dry in the pores of the woven belts they are later on released as dust. Such released dust may create health problems in particular when a person, for example a firefighter, is exposed to a harness on a daily basis.

Another disadvantage of woven belts is that they cannot take and stay in a predetermined shape so that is easier for the carrier to get into the harness. In an emergency situation it can be beneficial when the harness is shaped so that is easy for a person to engage in the harness or in other words so that it is easy for a carrier to put her/his arms and shoulders into the harness.

US 2011/0048421 A1 discloses a previously known carrying system for breathing apparatus. This carrying system comprises a backplate onto which an air cylinder may be mounted, a pair of shoulder straps which are attached at heir upper ends to the back plate and a waist strap attached to a lower region of the backplate.

SUMMARY

It is an object of the present invention to provide an enhanced harness for a breathing apparatus.

Another object is to provide such a harness which is ergonomic and easy to use.

Yet another object is to provide such a harness which is easy to keep clean.

Still an object is to provide a harness which is robust and reliable in use.

A further object is be to provide a harness that is economic to maintain and comparably cheap to manufacture.

Another object is to provide a method of manufacturing such a harness.

Still another object is to provide such a method by which the enhanced harness may be manufactured in a comparatively simple and cost effective manner.

These objects are achieved by means of a harness a defined by the appended claims 1 and 23

The harness is intended for attaching a breathing apparatus. The harness comprises an interface member having an elongated shape, said interface member being configured for receiving a container of breathable gas of the breathing apparatus. A hip belt is connected to the interface member at a first region of the interface member. A first shoulder belt and a second shoulder belt are connected to the interface member at the first region and at a second region (of the interface member. The hip belt and/or the first and second shoulder belts comprise at least one first moulded heat resistant plastic material.

The first and second shoulder belts are configured to extend over a carrier's upper torso when the harness is worn by the user or carrier. Typically the first and second shoulder belts extend over the carriers chest and are connected to the interface member close the carrier's hip.

A harness of the above described type is easy to clean since it is predominantly made of a moulded plastic which has a smooth surface and which is non-porous. Dust, smoke and soot particles can therefore not enter into pores or the like of the harness and these particles can be washed away comparably easy after the harness has been in use.

The moulded heat resistant plastic material preferably forms a predominant part of the weight carrying hip belt and/or shoulder belts. Utilizing a moulded heat resistant plastic material allows for that the material properties of the hip and shoulder belts may be chosen and fine tuned very precisely by selecting suitable plastic compositions and regulating the moulding parameters.

In a preferred embodiment both the hip belt and the first and second shoulder belts comprise the first moulded heat resistant material.

There are many different types of plastic and the first type of heat-resistant plastic may preferably be chosen so that it can be injection moulded and so that is has a smooth and non-porous surface after the injection moulding. This further eases the cleaning of the harness, as mentioned above.

The first moulded heat resistant material may be semi-rigid. By this is meant that the material is rigid enough to maintain the shape given when moulded but that it may be deformed by applying a moderate force. By this means the hip and shoulder belts may be given a preferable nominal form during manufacturing and to maintain this nominal form. E.g. the hip and shoulder belts may be given a nominal form which generally corresponds to the hip and shoulders of a person such that it is easy for the user to quickly apply the belts over the hip and shoulders. Since the material is solely semirigid, the hip and shoulder belts are capable of adapting their form exactly to the shape of different users. The capability of maintaining a nominal form also reduces the risk that the hip and shoulder belts tangle when not in use, thereby reducing the time needed for putting on the harness.

The first moulded heat resistant material may be elastic or resilient. This enhances the capability of the hip and shoulder belts to adapt the form to different users. Additionally, the elastic or resilient properties allows for that the hip and shoulder belts may be folded or pressed towards the interface member when not in use and for that they automatically regains the nominal form when released. If the harness, e.g. for space saving reasons is stored with folded hip and shoulder belts, the belts will immediately and automatically regain the nominal form when the harness is being prepared for use. This also reduces the time needed for putting on the harness.

The hip belt and the first and second shoulder belts may exhibit an ergonomic shape, so that the hip belt and the first and second shoulder belts fit a torso of a wearer of the harness.

The hip belt and the first and second shoulder belts may thus have a predetermined ergonomic shape basically ready to receive the carrier. The hip belt may be shaped so that it forms an open ellipse so that the carrier can easily fit his hip into the hip belt when she/he puts on the harness. The first and second shoulder belts may have an ergonomic or anatomic shape. They may extend away from the interface member so that the carrier can easily fit his arms into the first and second shoulder belts when the harness is put on.

The comfort of the harness and handling of the harness may thus be improved by providing a predetermined ergonomic shape of the shoulder belts and the hip belt.

Since the hip belt and the first and second shoulder belts are at least partially flexible, the ergonomic shape does not prevent the packing or storing of the harness in a storage saving way since the hip belt and the first and second shoulder belts may just be pressed or pushed towards the interface member for storage. Once the harness is then taken out of storage the hip belt and the first and second shoulder belts will then again move back into the predetermined ergonomic shape due to their elasticity.

The hip belt and/or the at least one shoulder belt may further comprises a rubber material. Natural and synthetic rubber may be given comparatively high degree of softness and a suitable friction. Thereby rubber material may be used when forming the hip and shoulder belts for enhancing the comfort in use and for increasing the friction between the hip and shoulder belts and the clothes of the user, such that the harness is securely held in place when worn.

At least a portion of an edge of the hip belt and/or at least one shoulder belt may comprise the rubber material. This greatly enhances the comfort, since it reduces the risk that sharp edges formed of a comparatively hard first moulded heat resistant material to chafe or cut into the body of the wearer.

At least a portion of an edge of the hip belt and/or at least one shoulder belt may be formed of the rubber material. By this means the edges may be entirely formed of rubber, thereby giving the edges any desirable softness.

The hip belt and/or the shoulder belts may be formed with a hinge portion, which may comprise the rubber material. The hinge portion may be arranged in proximity to the connection of the hip belt and/or the shoulder belts respectively to the interface member. Such a hinge portion is thus arranged at portions of the hip and shoulder belts which are subject to frequent and comparatively great bending movements when the harness is put on and taken off the wearer. By utilising a rubber material at these hinge portions, the capability to sustain repeated bending. Additionally the rubber may enhance the comfort at these portions.

In one embodiment the first moulded heat resistant material of the hip and/or shoulder belts may be substantially embedded in rubber material such that the edges, an outer side and an inner side of the hip belt and/or at least one shoulder belt are coated with the rubber material. By this means the comfort at use is further enhanced and the hip and shoulder belts are given are given enhanced tactile properties and high quality feeling. Additionally, manufacturing may be simplified by this means The rubber material may be applied to the hip and shoulder belts in different ways.

The rubber material may e.g. coated onto the first heat resistant plastic material.

The rubber material may be vulcanized onto the first heat resistant plastic material.

Alternatively, the rubber material may be co-moulded with the first heat resistant material.

In a further embodiment at least one of the first shoulder belt or the second shoulder belt may comprise an eyelet, which is integrally formed with said first or second shoulder belt during the moulding manufacturing process.

The eyelet may serve for various purposes such as for example for connecting tools, such as torches, evacuation ropes, knives, etc.

The hip belt and/or the first and second shoulder belts may comprise a further moulded heat resistant plastic material, the properties of which differ from the first moulded heat resistant material. By this means different portions of the belts may be given different properties, such as different stiffness, softness, friction, strength and the like The further moulded heat resistant plastic material may e.g. have a lower bending resistance than the first moulded heat resistant plastic material.

For example, a hinge portion of the hip belt and/or the shoulder belts may comprise the further moulded heat resistant plastic material. The hinge portion may be arranged in proximity to the connection of the hip belt and/or the shoulder belts respectively to the interface member. By this means the adaptation of the hip and shoulder belts to the shape of the user when putting on the harness is enhanced. Additionally, this may reduce the risk of material failure by fatigue at the hinge portions.

The further moulded heat resistant plastic material may be co-moulded with the first moulded heat resistant plastic material. This may facilitate the manufacturing of the harness.

The further moulded heat resistant plastic material may be a rubber material.

The harness may comprise a first shoulder belt adjusting mechanism and a second shoulder belt adjusting mechanism, the first and second shoulder belt adjusting mechanism being provided for adjusting the length of the first and second shoulder belts, respectively.

The first and second shoulder belt adjusting mechanisms may be used to adjust the length of the first and second shoulder belts of the harness.

The harness may also comprise a hip belt adjusting mechanism, the hip belt adjusting mechanism being configured to adjust the length of the hip belt.

The harness may thus be adaptable to various sizes of different persons/carriers.

The adjusting mechanisms may be designed in a known way or each adjusting mechanism may comprise a toothed belt and a ratchet whereby the toothed belt may be inserted into the ratchet.

The toothed belt and the ratchet of each adjusting mechanism may be made of hard smooth non-porous material, for example plastic, so that they are easy to clean. Such ratchet/toothed belt mechanism are for example used in Snowboard bindings.

The first and second shoulder belt adjusting mechanism may be connected to the first and second shoulder belt, respectively, and the interface member in the first region of the interface member.

The harness may further comprise a shoulder belt connecting piece connected to the interface member in the first region, whereby the first and second shoulder belts are connected to the shoulder belt connecting piece.

The first and second shoulder belts preferably form an integral single shoulder pad. By this means both shoulder belts may be formed in a single moulding operation. This also reduces the number of constituent components needed for assembling the harness.

The first and second shoulder belts may then be connected at their upper ends. This joint upper portion of the shoulder pad may the be used for attaching the shoulder pad to the interface member.

The invention also relates to a method of producing a harness as described above. The method comprising the steps of:

providing an interface member having an elongated shape, said interface member being configured for receiving a container of breathable gas of the breathing apparatus;

forming a hip belt, by moulding at least one first heat resistant plastic material forming a first shoulder belt and a second shoulder belt by moulding at least one first heat resistant plastic material connecting the hip belt to the interface member at a first region of the interface member, and connecting the first and second shoulder belts to the interface member at the first region and at a second region of the interface member.

By this means a harness with desired and advantageous properties may readily be manufactured in a simple and cost effective manner. The moulding operations also allows for that the material properties of the hip and shoulder belts may be chosen and tuned very precisely by selecting suitable plastic compositions and regulating the moulding parameters.

The step of forming the hip belt and/or the step of forming the first and second shoulder belts may comprises co-moulding at least two heat resistant plastic materials.

The step of forming the hip belt and/or the step of forming the first and second shoulder belts may comprise injection moulding, extrusion moulding compression moulding or lamination moulding.

This may provide for an at least more or less cheap manufacturing of the harness.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
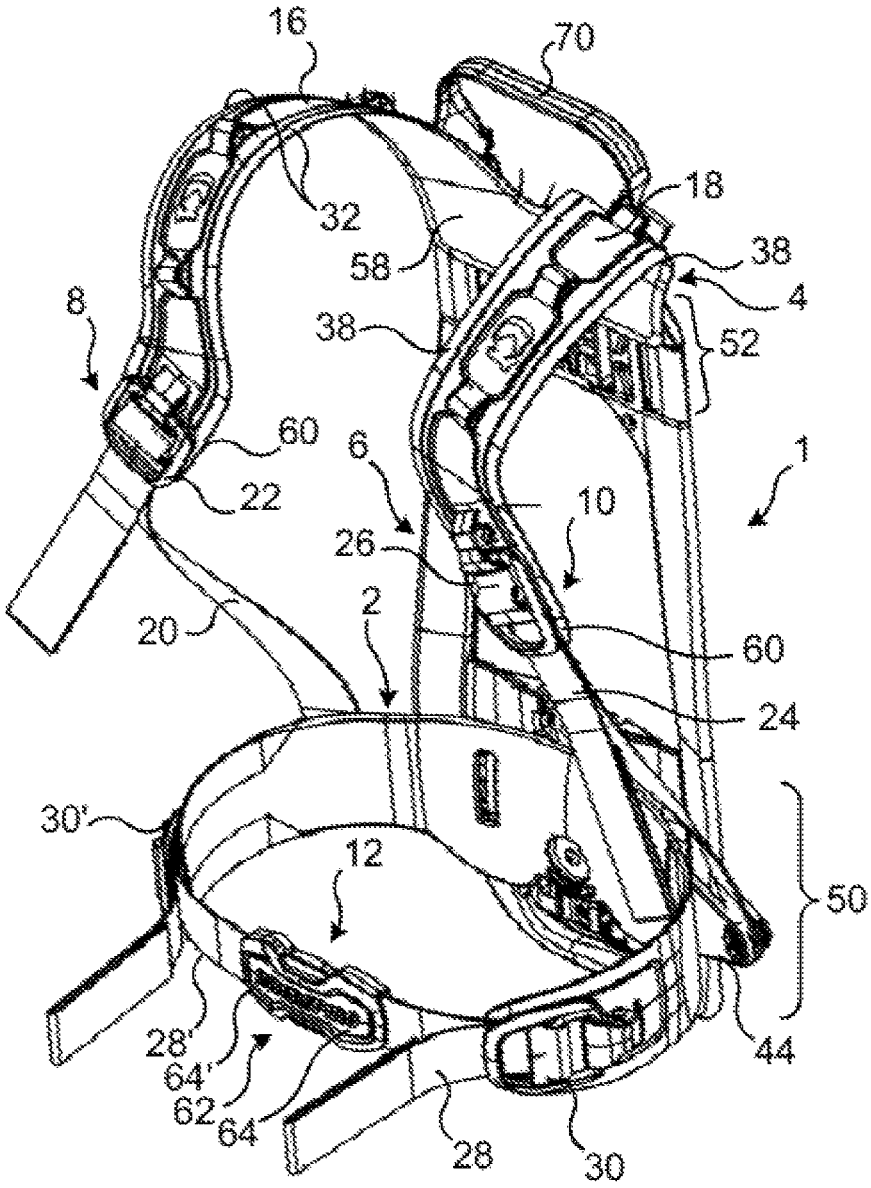
FIG. 1 schematically illustrates a perspective view of a harness according to the invention.
Figure 2:
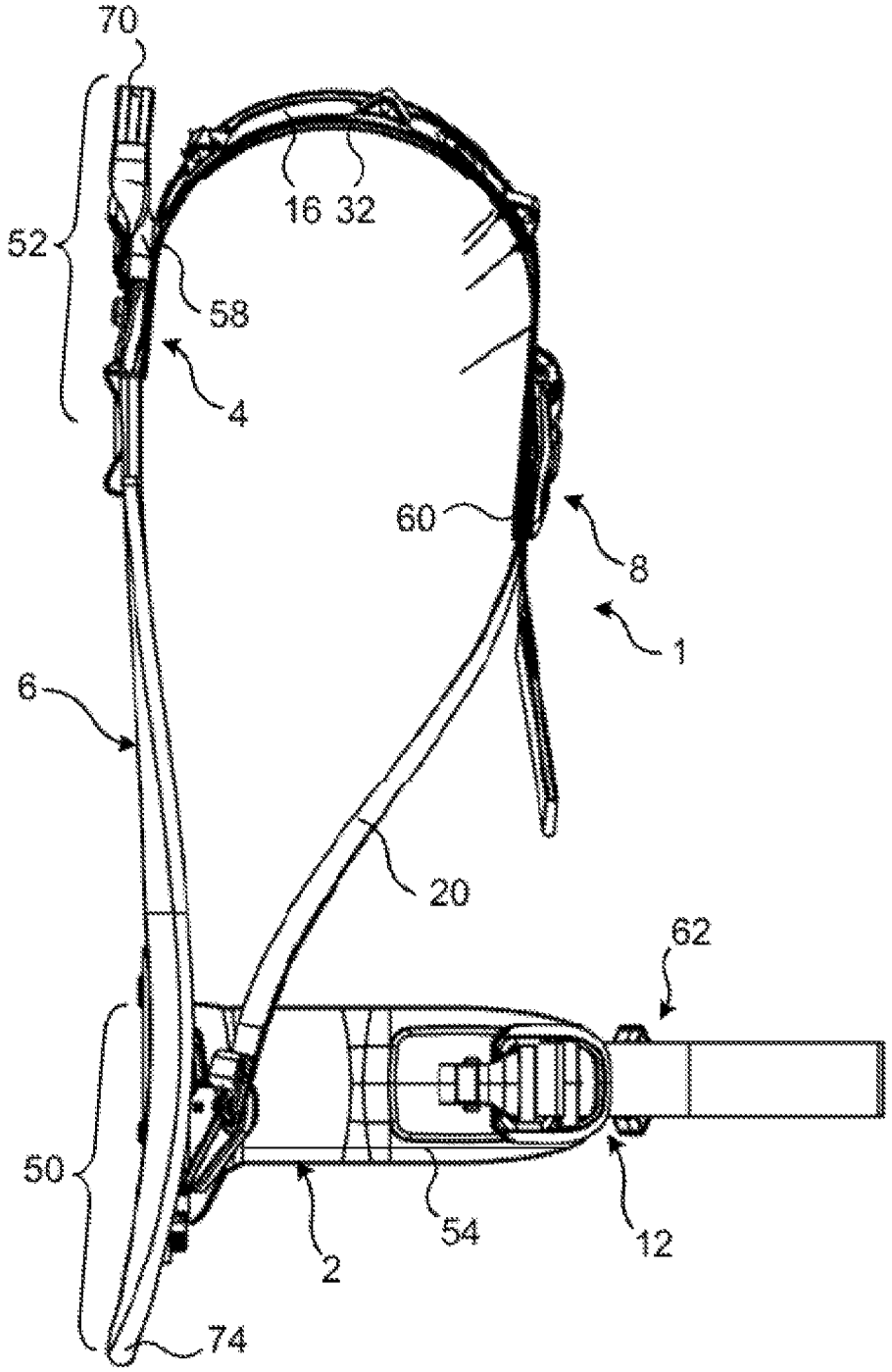
FIG. 2 schematically illustrates a side view of the harness shown in FIG. 1 but from another side.

Referring now to FIGS. 1 and 2 an embodiment of a harness 1 is described. The harness 1 comprises a hip belt 2, an elongated interface member 6 and a shoulder pad 4 having a first shoulder belt 16 and a second shoulder belt 18. The elongated interface member 6 is shaped longitudinal in the direction of a carrier's back when the harness is worn by a person.

The first shoulder belt 16 and the second shoulder belt 18 have an ergonomic shape so that they are comfortable to wear also under difficult circumstances when under pressure and when exposed to a tough environment.

The interface member 6 is configured to receive and hold a container (not shown) comprising breathable gas, said container being part of a breathing apparatus (not shown) as it is used for example by firefighters and divers. The interface member 6 may be made of a heat-resistant rigid plastic or another rigid and heat-resistant material.

The shoulder pad 4 comprises the first shoulder belt 16 and the second shoulder belt 18. The first and second shoulder belts 16, 18 are connected to each other at upper ends 58 and they are configured to extend over the shoulders of a carrier down the chest of the carrier, when the harness is worn by a carrier. The length of the first and second shoulder belts 16, 18 may vary, in all cases they extend however well beyond and over the carrier's chest. The shoulder pad 4 is connected to the interface member 6 where the first and the second shoulder belts 14, 16 merge, thus at their respective upper ends 58. The shoulder pad 4 may be connected to the interface member 6 in a second region 52 thereof via a screw/stem connection or via a clamp mechanism as will be described later on referring to FIG. 4. The second region 52 is located close the shoulders/neck of the carrier when the harness 1 is worn by a person/the carrier.

Figure 5:
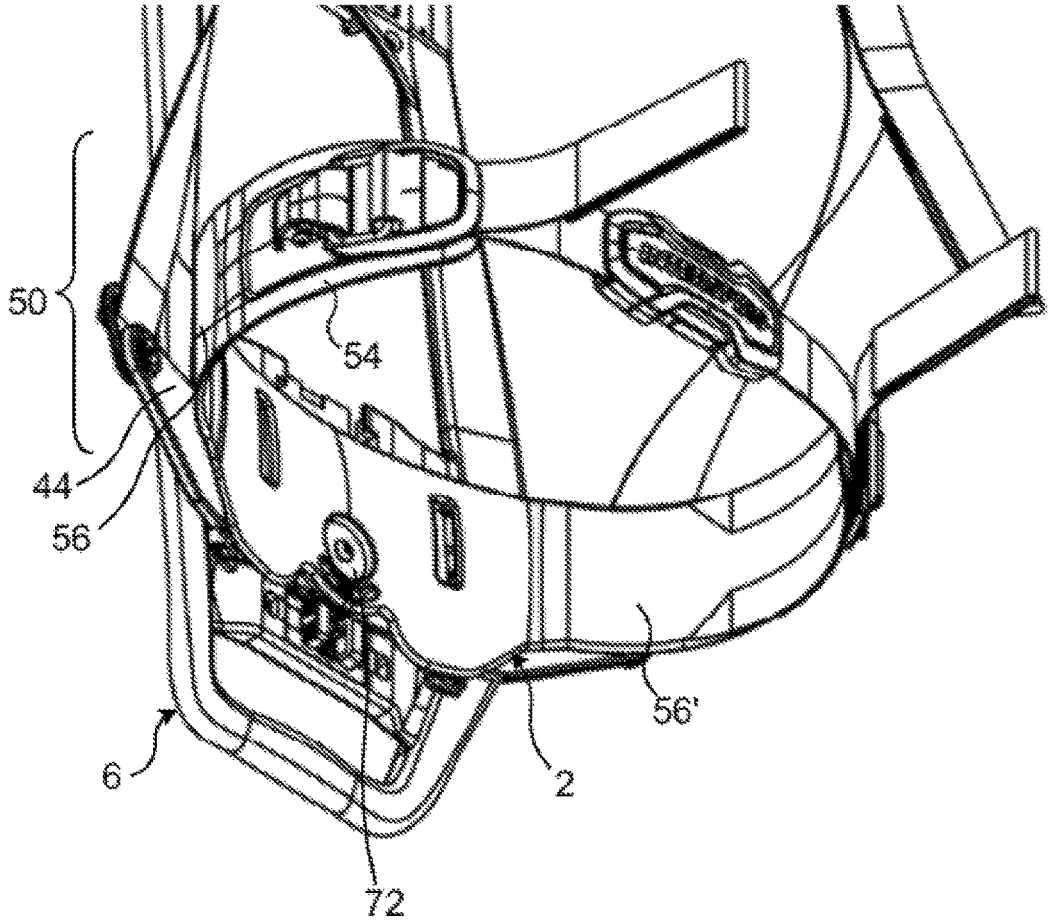
FIG. 5 schematically illustrates an enlarged view of a lower part of the harness illustrating the hip belt and how the hip belt is connected to the interface member.

FIG. 1 further illustrates the hip belt 2 which is connected to the interface member 6 in a first region 50. The first region 50 is located close the carriers hip when the harness 1 is worn by the carrier. The hip belt 2 is connected to the interface member 6 via a screw/stem connection as it is also illustrated in FIG. 5.

The hip belt 2, the first and second shoulder belts 16, 18 and thus the shoulder pad 4 comprise a first type of heat-resistant plastic. Preferably the hip belt 2 and the first and second shoulder belts 16, 18 are made of the first type of heat-resistant plastic for example by a moulding manufacturing process such as injection moulding or the like. Such a moulding manufacturing process results in that the hip belt 2, the shoulder pad 4 and thus the first and second shoulder belts 16, 18 are smooth and non-porous while still being elastic and heat-resistant.

There are various ways to achieve a plastic with the desired characteristics, which will be not specifically described herein.

The first shoulder belt 16 and the second shoulder belt 18 may further comprise rubber-extended edges 32, 38 or edges 32, 38 coated with rubber to increase the comfort for the carrier. In the same way may the hip belt 2 comprise rubber-extended edges 54 or edges 54 coated with rubber to increase the comfort for the carrier. The rubber is comparably soft and avoids that the hip belt 2 and in particular the first and second shoulder belts 16, 18 cut into the soft tissue of the carrier when the harness 1 is worn. The rubber may be integrally formed on the hip belt 2 and the first and second shoulder belts 16, 18, respectively, during the moulding manufacturing process or it may be vulcanized onto the first type of heat resistant plastic after the moulding manufacturing.

The first and second shoulder belts 16, 18 are connected to a shoulder belt connecting piece 44 by means of a first shoulder belt adjusting mechanism 8 and a second shoulder belt adjusting mechanism 10, respectively. The shoulder belt connecting piece 44 is arranged in between the interface member 6 and the hip belt 2, as shown in FIG. 1. The shoulder belt connecting piece 44 is made of rigid and stiff material such as rigid heat-resistant plastic, similar or the same as used for the interface member 6. As shown in FIG. 1, the shoulder belt connecting piece 44 extends on both lateral side of the interface member 6 beyond the latter whereby the first and second shoulder belts 16, 18 are connected to these extensions. The first shoulder belt adjusting mechanism 8 and the second shoulder belt adjusting mechanism 10 interconnect the second ends of the first and second shoulder belts 16, 18, respectively, to the shoulder belt connecting piece 44.

It is hereby noted that although the shoulder belt connecting piece 44 is shown it is also possible to connect the first and second shoulder belts 16, 18 via the hip belt 2 to the interface member 6 or to connect them directly to the interface member 6. Such an embodiment would render the shoulder belt connecting piece 44 redundant.

In the illustrated embodiment of the harness 1, the first and second shoulder belt adjusting mechanisms 8, 10 may each comprise a retaining element 22, 26, for example in the form of a retaining knuckle and an extension element 20, 24, for example in the form of a flexible band such as a woven fabric or the like. The retaining elements 22, 26 may be attached to lower ends 60 of the first and second shoulder belt 16, 18, respectively and the extension elements 22, 26 may be attached to the shoulder belt connecting piece 44. The extension elements 22, 26 may then each be threaded into their respective retaining element 20, 24 so that the carrier can adjust the length of the first and/or second shoulder belt 16, 18.

Similarly as the first and second shoulder belt adjusting mechanism 8, 10 is there provided a hip belt adjusting mechanism 12 comprising on each free end of the hip belt 2 a retaining element 30, 30', for example in the form of a retaining knuckle, attached in a region of a free end of the hip belt 2 and two extension elements 28, 28', for example in the form of a flexible band such as a woven fabric or the like, which are threaded into the retaining elements 30, 30'. One of the two extension elements 28' is connected to or threaded into a female piece 64' of a snap mechanism 62 and the other of extension element 28 is connected to or threaded into a male piece 64 of the snap mechanism 62. In order to adjust the length of the hip belt 2 the carrier may then simply pull on the free ends of the extension elements 28, 28' when the snap mechanism 62 is closed.

In view of the above it is clear that other embodiments of a hip belt adjusting mechanism 12 may be envisaged. There may for example be only one retaining element (not shown) fixed to either the female or male piece 64', 64 of the snap mechanism 12 whereby the free respective other ends of the extension elements are fixedly attached to the male piece 64 and the free ends of the hip belt 2.

FIGS. 1 and 2 further illustrate a handle 70 which may be used to carry the harness when it is not worn by a person. Additionally the first region 50 of the interface member 6 may comprise an extension 74 (best illustrated in FIG. 2) to protect at least a part of the breathing apparatus.

In another embodiment, which is not shown in the drawings, it may be envisaged to embody the extension elements 20, 24 of the first and second shoulder belt mechanisms 8, 10 with a toothed belt or strap and the retaining elements 22, 26 of the first and second shoulder belt mechanisms 8, 10 with a ratchet so that the toothed belt can be threaded into the ratchet. The ratchet may then be easily used to adjust the length of the first and/or second shoulder belt 16, 18, respectively.

The retaining elements 30, 30' and the extension elements 28 and the snap mechanism 62 of the hip belt adjusting mechanism 12 may be embodied in a similar manner. One of the extension elements 28, 28' may be replaced with a plastic strap (not shown) attached at one end to one of the free ends of the hip belt 2, whereby at the free end of the plastic strap a ratchet may be connected or attached. The other of the extension elements 28, 28' may then be embodied in the form of a toothed belt or strap, which at one end is attached to the other free end of the hip belt 2 and which other free end of the toothed belt may be threaded into or engaged with the ratchet.

Figure 3:
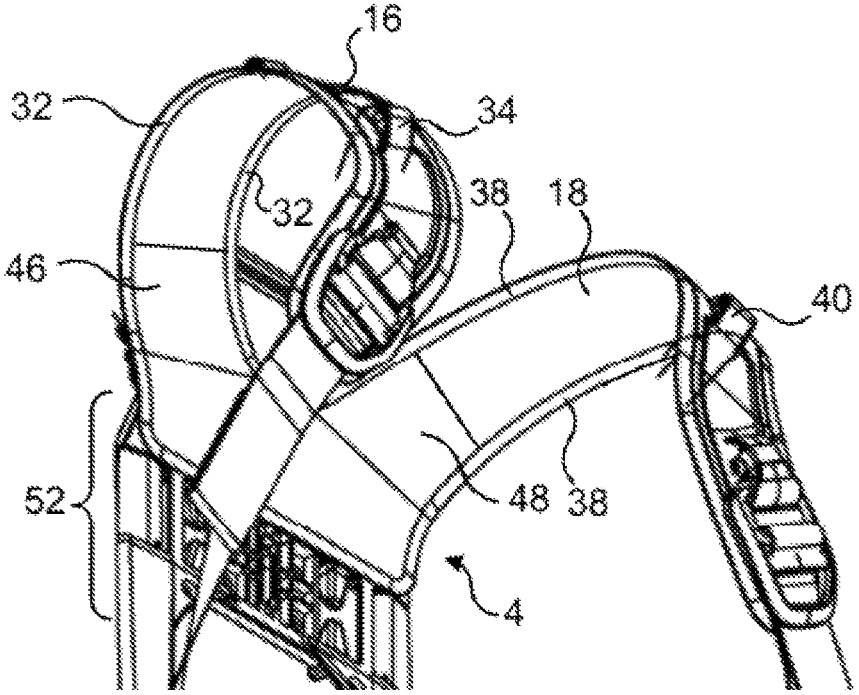
FIG. 3 schematically illustrates a perspective view of an upper part of the harness.

FIG. 3 illustrates the first and second shoulder belts 16, 18 and how they are connected at one of their ends. Alternatively the first shoulder belt 16 and the second shoulder belt 18 may be separated from each other and not be connected. The first shoulder belt 16 and the second shoulder belt 18 may thus be produced separately.

As illustrated in FIG. 3, the first shoulder belt 16 and the second shoulder belt 18 may comprise eyelets 34, 40 for receiving various tools or connectors. The eyelets 34, 40 may be configured to receive hooks for holding a pipe supplying breathable gas to the carrier as illustrated with eyelet 34. Alternatively the eyelets may comprise hooks or rings to receive torches or other useful equipment.

Close to the second region 52 of the interface member 6, the first shoulder belt 16 and the second shoulder belt 18 comprise each a shoulder belt section which forms a hinge portion 46, 48 that is configured to be more flexible than the other parts of the first shoulder belt 16 and the second shoulder belt 18. These hinge portions 46, 48 may comprise a second type of heat-resistant plastic that is softer than the first type of heat-resistant plastic. The second type of heat resistant plastic may for example be rubber. The hinge portions 46, 48 may be in the range of 2 to 20 cm long, preferably 5 to 15 cm as measured in a longitudinal direction of the first and second shoulder belts 16, 18, respectively.

The hinge portions 46, 48 may be formed of the first moulded heat resistant plastic material being coated with or embedded in a rubber material The hinge portions 46, 48 may extend over part of the width of the respective first or second shoulder belt 16, 18 or they may extend over the entire width of the corresponding shoulder belt 16, 18.

In order to provide these hinge portions 46, 48 it may for example be possible to provide a structure comprising the first type of heat-resistant plastic and the second type of heat-resistant plastic. The first type of heat-resistant plastic and the second type of heat resistant plastic of the sections may be integrally connected to the first type of heat-resistant plastic of the rest of the first and second shoulder belt 16, 18, respectively. The first type of heat-resistant plastic and the second type of heat-resistant plastic may be chosen so that they can be easily injection moulder in one step.

Also at such an arrangement it is possible that the second material forming the hinge portions 46, 48 and/or the first material forming the rest of the shoulder belts is/are coated with or embedded in a rubber material.

Figure 4:
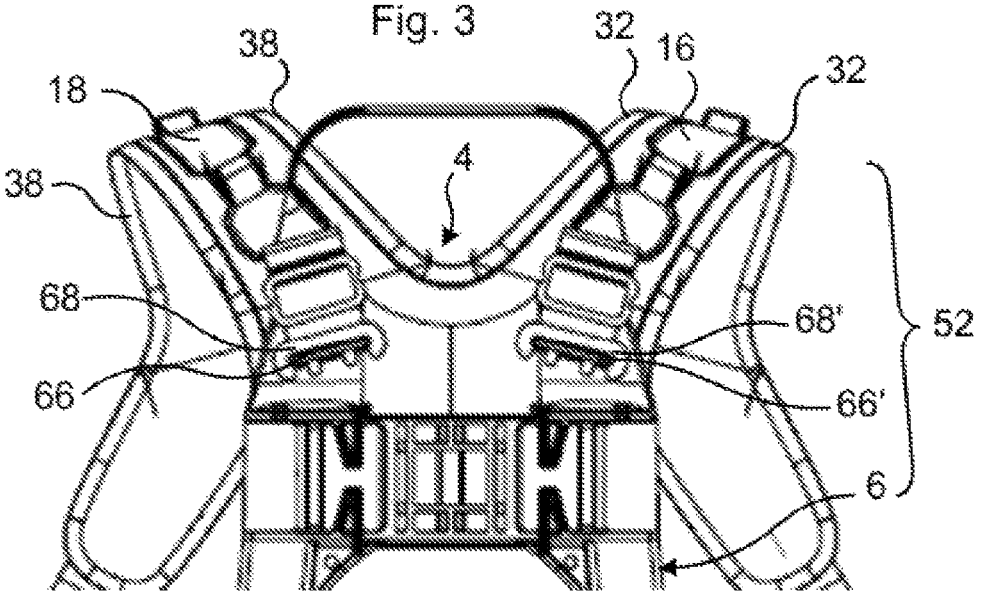
FIG. 4 schematically illustrates a view of the upper part back side of the harness.

FIG. 4 illustrates how the shoulder pad 4 and the first and second shoulder belts 16, 18, respectively, are connected to the interface member 6 in the second region 52. First and second shoulder belts 16, 18 may each comprise projections 66, 66' at or close to their ends that are configured to be connected to the second region 52 of the interface member 6. The projections 66, 66' may comprise cut outs or the like in which a blocking piece 68, 68' may engage and secure the shoulder pad 4 and first and second shoulder belts 16, 18, respectively to the interface member 6 in a clamping engagement. Although this specific clamping connection is shown in the figures, it is also possible to connect the shoulder pad 4 and the first and second shoulder belts 16, 18, respectively by a screw/stem engagement having washers or not. Such a screwed connection may preferably comprise more than one screw and more than one stem.

Similar to the first and second shoulder belts 16, 18 may also the hip belt 2 comprise hip belt sections, which form hinge portions 56, 56' similar to the above described shoulder belt section 46, 48 and as illustrated in FIG. 5. These hip belt hinge portions 56, 56' may be located preferably close to the first region 50 of the interface member 6 on either side of the interface member 6. Again as previously described these hip belt hinge portions 56, 56' may partially comprise the second type of heat-resistant plastic and partially the first type of heat-resistant plastic or they may alternatively only comprise the second type of heat-resistant plastic. Also these hinge portions may be coated with or embedded in a rubber material.

The hip belt hinge portions 56, 56' enhance the comfort and handling of the harness 1.

FIG. 5 additionally illustrates the screw/stem connection 72, which is used to connect the hip belt 2 to the interface member 6.

The hip belt hinge portions 56, 56' may extend over the entire width of the hip belt 2. Alternatively the hip belt hinge portions 56, 56' may extend only over part of the hip belt 2. The length of each of the hip belt hinge portions 56, 56' as measured in a longitudinal direction of the hip belt 2 may be in a range of 3 to 15 cm preferably 5 to 12 cm.

The harness may readily be produced by utilizing the following process steps:

Providing an interface member (6) having an elongated shape, said interface member being configured for receiving a container of breathable gas of the breathing apparatus.

Forming a hip belt (2), by moulding at least one first heat resistant plastic material.

Forming a first shoulder belt (16) and a second shoulder belt (18) by moulding at least one first heat resistant plastic material.

Connecting the hip belt (2) to the interface member at a first region (50) of the interface member.

Connecting the first (16) and second (18) shoulder belts to the interface member at the first region and at a second region (52) of the interface member.

The step of forming the hip belt and/or the step of forming the first and second shoulder belts may comprise co-moulding at least two heat resistant plastic materials.

The step of forming the hip belt and/or the step of forming the first and second shoulder belts may comprise injection moulding, extrusion moulding compression moulding or lamination moulding.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A harness for a breathing apparatus, the harness comprising:

an interface member having an elongated shape, said interface member being configured for receiving a container of breathable gas of the breathing apparatus;

a hip belt connected to the interface member at a first region of the interface member, and a first shoulder belt and a second shoulder belt, the first and second shoulder belts being connected to the interface member at the first region and at a second region of the interface member;

wherein the hip belt and/or the first and second shoulder belts comprise at least one first moulded heat resistant plastic material and a rubber material, wherein at least a portion of the first moulded heat resistant material is embedded in the rubber material.

2. The harness according to claim 1, wherein the first moulded heat resistant plastic material is a non-porous material.

3. The harness according to claim 1, wherein the first moulded heat resistant material is semi-rigid.

4. The harness according to claim 1, wherein the first moulded heat resistant material is elastic.

5. The harness according to claim 1, wherein the hip belt and the first and second shoulder belts exhibits an ergonomic shape, so that the hip belt and the first and second shoulder belts fit a torso of a wearer of the harness.

6. The harness according to claim 1, wherein at least a portion of an edge of the hip belt and/or at least one shoulder belt comprises the rubber material.

7. The harness according to claim 6, wherein at least a portion of an edge of the hip belt and/or at least one shoulder belt is formed of the rubber material.

8. The harness according to claim 1, wherein a hinge portion of the hip belt and/or the shoulder belts comprises the rubber material, which hinge portion is arranged in proximity to the connection of the hip belt and/or the shoulder belts respectively to the interface member.

9. The harness according to claim 1, wherein at least one edge, an outer side, and an inner side of the hip belt and/or at least one shoulder belt are coated with the rubber material.

10. The harness according to claim 1, wherein the rubber material is coated onto the first heat resistant plastic material.

11. The harness according to claim 1, wherein the rubber material is vulcanized onto the first heat resistant plastic material.

12. The harness according to claim 1, wherein the rubber material is co-moulded with the first heat resistant material.

13. The harness according to claim 1, wherein at least one of the first shoulder belt or the second shoulder belt comprises an eyelet, which is integrally moulded with said first or second shoulder belt.

14. The harness according to claim 1, wherein the hip belt and/or the first and second shoulder belts comprises a further moulded heat resistant plastic material, the properties of which differ from the first moulded heat resistant material.

15. The harness according to claim 14, wherein the further moulded heat resistant plastic material has a lower bending resistance than the first moulded heat resistant plastic material.

16. The harness according to claim 14, wherein a hinge portion of the hip belt and/or the shoulder belts comprises the further moulded heat resistant plastic material, which hinge portion is arranged in proximity to the connection of the hip belt and/or the shoulder belts respectively to the interface member.

17. The harness according to claim 14, wherein the further moulded heat resistant plastic material is co-moulded with the first moulded heat resistant plastic material.

18. The harness according to claim 14, wherein the further moulded heat resistant plastic material is a rubber material.

19. The harness according to claim 14, comprising a first shoulder belt adjusting mechanism and a second shoulder belt adjusting mechanism, the first and second shoulder belt adjusting mechanism being provided for adjusting the length of the first and second shoulder belts, respectively.

20. The harness according to claim 14, comprising a hip belt adjusting mechanism, the hip belt adjusting mechanism being configured to adjust the length of the hip belt.

21. The harness according to claim 14, comprising a shoulder belt connecting piece connected to the interface member in the first region, wherein the first and second shoulder belts are connected to the shoulder belt connecting piece.

22. The harness according to claim 14, wherein the first and second shoulder belts form an integral single shoulder pad.

23. The harness according to claim 22, wherein the first and second shoulder belts are connected at their upper ends.

24. Method of producing a harness for a breathing apparatus, the method comprising the steps of:

providing an interface member having an elongated shape, said interface member being configured for receiving a container of breathable gas of the breathing apparatus;

forming a hip belt, by moulding at least one first heat resistant plastic material such that at least a portion of the at least one first heat resistant plastic material is embedded in a rubber material forming a first shoulder belt and a second shoulder belt by moulding at least one first heat resistant plastic material such that at least a portion of the at least one first heat resistant plastic material is embedded in a rubber material connecting the hip belt to the interface member at a first region of the interface member, and connecting the first and second shoulder belts to the interface member at the first region and at a second region of the interface member.

25. The method according to claim 24, wherein the step of forming the hip belt and/or the step of forming the first and second shoulder belts comprises co-moulding at least two heat resistant plastic materials.

26. The method according to claim 24, wherein the step of forming the hip belt and/or the step of forming the first and second shoulder belts comprises injection moulding, extrusion moulding compression moulding or lamination moulding.

* * * * *